US012497254B2

(12) United States Patent
Hanaoka et al.

(10) Patent No.: US 12,497,254 B2
(45) Date of Patent: Dec. 16, 2025

(54) MEDIUM TRANSPORT DEVICE AND RECORDING DEVICE

(71) Applicant: SEIKO EPSON CORPORATION, Tokyo (JP)

(72) Inventors: Keita Hanaoka, Matsumoto (JP); Ryoichi Morisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 389 days.

(21) Appl. No.: 18/168,835

(22) Filed: Feb. 14, 2023

(65) Prior Publication Data

US 2023/0257222 A1 Aug. 17, 2023

(30) Foreign Application Priority Data

Feb. 16, 2022 (JP) ..... 2022-021892

(51) Int. Cl.
*B65H 5/06* (2006.01)

(52) U.S. Cl.
CPC ..... *B65H 5/062* (2013.01); *B65H 2402/441* (2013.01); *B65H 2402/45* (2013.01); *B65H 2404/14212* (2013.01); *B65H 2404/144* (2013.01)

(58) Field of Classification Search
CPC ..... B65H 5/062; B65H 2402/441; B65H 2402/45; B65H 2404/14212; B65H 2404/144
See application file for complete search history.

(56) References Cited

U.S. PATENT DOCUMENTS 5,765,825 A * 6/1998 Watase ..... B65H 1/08 271/9.13
6,829,453 B2 * 12/2004 Kouzu ..... G03G 21/1638 399/124
6,993,268 B2 * 1/2006 Otaka ..... G03G 15/6511 271/3.03
2004/0175210 A1 9/2004 Otaka
2007/0057448 A1 * 3/2007 Hiura ..... G03G 21/1638 271/273
2012/0248680 A1 * 10/2012 Takaishi ..... G03G 15/234 271/272

(Continued)

FOREIGN PATENT DOCUMENTS

JP 2004-269151 A 9/2004
JP 2022-100017 A 7/2022

*Primary Examiner* — Thomas A Morrison
(74) *Attorney, Agent, or Firm* — WORKMAN NYDEGGER

(57) ABSTRACT

A medium transport device includes a first roller 9, a second roller 11, a first rotation shaft 13 supporting the first roller, a displacement mechanism 15 configured to displace the first rotation shaft to a first position P1 where the first roller and the second roller are configured to nip the medium and to a second position P2 where both 9 and 11 are separated from each other, and a door 7 configured to rotate into an opened position and into a closed position around an axis that intersects the first rotation, wherein the door includes an acting section 17, the displacement mechanism includes an action receiving section 19, and when the door 7 rotates to the closed position and the acting section 17 no longer pushes the action receiving section 19, the displacement mechanism displaces the first rotation shaft 13 from the first position to the second position.

13 Claims, 9 Drawing Sheets

(56) References Cited

U.S. PATENT DOCUMENTS

| | | | | |
|---|---|---|---|---|
| 2015/0266683 | A1* | 9/2015 | Inoue | B65H 5/062<br>271/226 |
| 2016/0185543 | A1* | 6/2016 | Osada | B65H 5/26<br>271/225 |
| 2022/0194725 | A1 | 6/2022 | Tamura | |

* cited by examiner

MEDIUM TRANSPORT DEVICE AND RECORDING DEVICE

The present application is based on, and claims priority from JP Application Serial Number 2022-021892, filed Feb. 16, 2022, the disclosure of which is hereby incorporated by reference herein in its entirety.

BACKGROUND

1. Technical Field

The present disclosure relates to a medium transport device and a recording device.

2. Related Art

As an example of the related art of this type of sheet transport device, there is the one described in JP-A-2004-269151. In JP-A-2004-269151, there is disclosed a sheet transport device in which an openable and closable door holds one roller of a pair of transport rollers and a device main body holds the other roller. When the door is opened, one roller is separated from the other roller by a lock mechanism interlocked with the door, so that the press-contact state of the pair of transport rollers is released.

In the sheet transport device of JP-A-2004-269151, a part for holding the one roller moves integrally with the door, so there is a concern that a mechanism on the door side may become complicated, and also that the weight of the door may increase so it is difficult to open and close the door.

SUMMARY

In order to solve the above problem, a medium transport device according to the present disclosure includes a first roller configured to transport a medium; a second roller configured to nip the medium together with the first roller; a first rotation shaft configured to rotatably support the first roller; a displacement mechanism configured to displace the first rotation shaft to a first position where the first roller and the second roller can nip the medium and a second position where the first roller is separated from the second roller; a device main body configured to support the displacement mechanism; and a door that is configured to open and close around a second rotation shaft, which is provided as a rotation fulcrum extending in a direction intersecting the first rotation shaft, and that is configured to rotate to an opened position at which the door opens with respect to the device main body and to a closed position at which the door closes with respect to the device main body, wherein the door includes an acting section, the displacement mechanism includes an action receiving section, when the door is at the closed position, the acting section and the action receiving section are in contact with each other and the first rotation shaft is located at the first position, and when the door is at the opened position, the acting section and the action receiving section are separated from each other and the first rotation shaft is positioned at the second position.

Further, a recording device according to the present disclosure includes the medium transport device and a recording section configured to perform recording on the medium transported by the medium transport device.

DESCRIPTION OF EMBODIMENT

Figure 1:
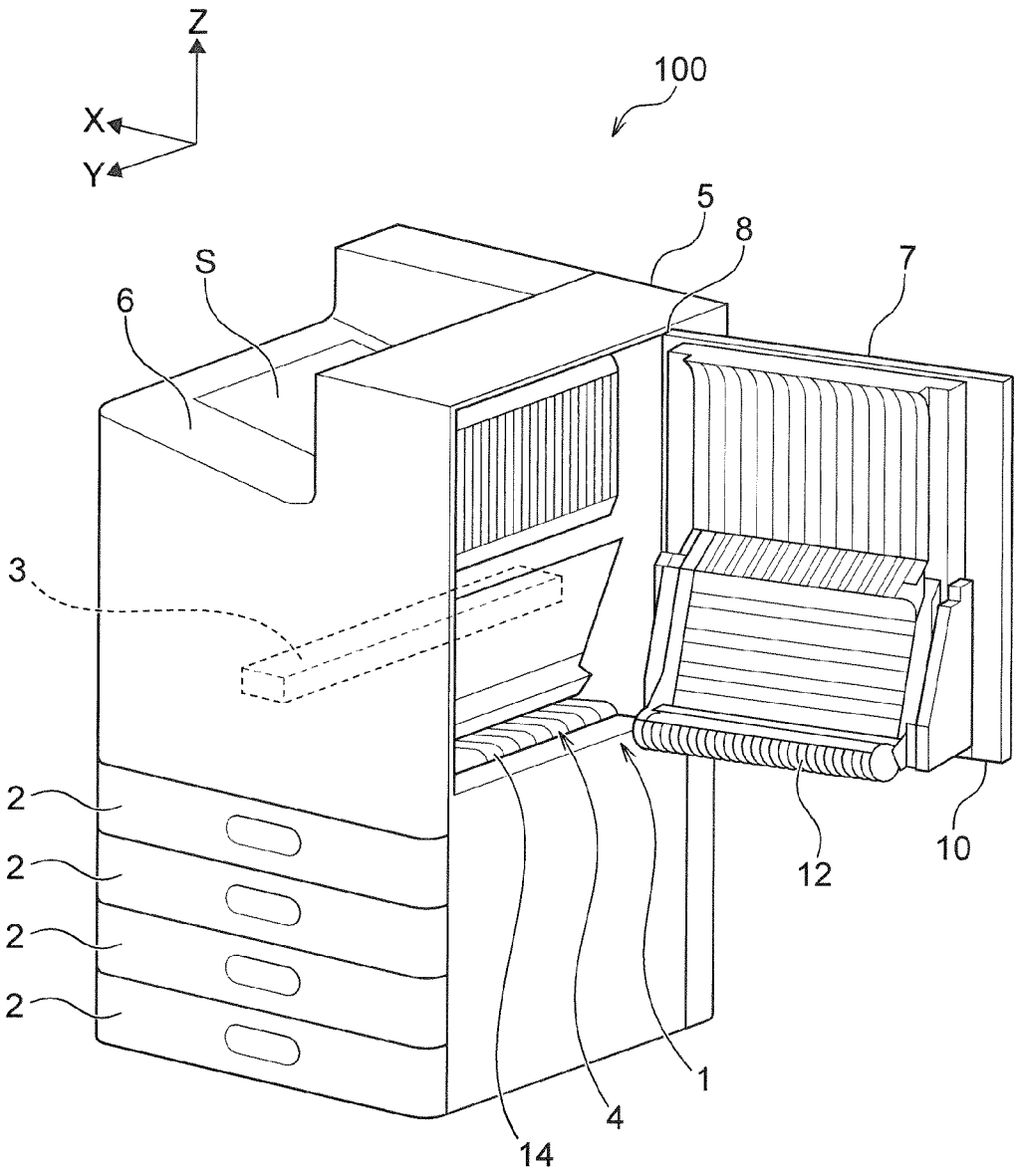
FIG. 1 is an overall schematic perspective view of a recording device according to a first embodiment.

The present disclosure present disclosure will be briefly described.

To solve the above problem, a medium transport device according to a first aspect of the present disclosure includes a first roller configured to transport a medium; a second roller configured to nip the medium together with the first roller; a first rotation shaft configured to rotatably support the first roller; a displacement mechanism configured to displace the first rotation shaft to a first position where the first roller and the second roller can nip the medium and a second position where the first roller is separated from the second roller; a device main body configured to support the displacement mechanism; and a door that is configured to open and close around a second rotation shaft, which is provided as a rotation fulcrum extending in a direction intersecting the first rotation shaft, and that is configured to rotate to an opened position at which the door opens with respect to the device main body and to a closed position at which the door closes with respect to the device main body.

Further, the door includes an acting section, the displacement mechanism includes an action receiving section, when the door is at the closed position, the acting section is in contact with and presses the action receiving section, and the displacement mechanism is configured so that when the door rotates from the closed position to the opened position and the acting section no longer pushes the action receiving section, the displacement mechanism displaces the first rotation shaft from the first position toward the second position.

According to this aspect, the door includes an acting section, the displacement mechanism includes an action receiving section, when the door is at the closed position, the acting section is in contact with and presses the action receiving section, and the displacement mechanism is configured so that when the door rotates from the closed position to the opened position and the acting section no longer pushes the action receiving section, the displacement mechanism displaces the first rotation shaft from the first position toward the second position. Accordingly, since only the acting section is provided on the door side, the mechanism on the door side is not complicated, weight is hardly increased, and there is little concern that the door is difficult to open and close.

The medium transport device according to a second aspect of the present disclosure according to the first aspect, wherein the displacement mechanism includes a first cam that is provided on one end side of the first rotation shaft and that is configured to rotate around a first shaft, a second cam that is provided on the other end side of the first rotation shaft and that is configured to rotate around a second shaft, a first contact section that is configured to rotate integrally with the first cam around the first shaft and that is configured to contact the one end of the first rotation shaft, and a second contact section that is configured to rotate integrally with the second cam around the second shaft and that is configured to contact the other end of the first rotation shaft.

And, when the acting section no longer pushes the action receiving section, the first cam rotates and the first contact section comes into contact with the one end of the first rotation shaft to move the one end of the first rotation shaft and the second cam rotates and the second contact section comes into contact with the other end of the first rotation shaft to move the other end of the first rotation shaft, thereby displacing the first rotation shaft from the first position to the second position.

According to this aspect, the structure for displacing the entire the first rotation shaft from the first position to the second position is configured by a cam structure including the first cam and the first contact section provided on one end side of the first rotation shaft and the second cam and the second contact section provided on the other end side of the first rotation shaft. Therefore, with a simple structure of a pair of the cam structures, the first roller can be separated from the second roller by displacing the one end and the other end of the first rotation shaft from the first position to the second position.

The medium transport device according to a third aspect of the present disclosure according to the second aspect, wherein the first cam and the second cam are applied with rotational force by a first rotational force applying member and a second rotational force applying member, respectively, and when the acting section no longer pushes the action receiving section, the first cam and the second cam are rotated by the rotational force to displace the first rotation shaft from the first position to the second position.

According to this aspect, when the acting section no longer pushes the action receiving section, the first cam and the second cam are rotated by rotational force to displace the first rotation shaft from the first position to the second position. Thus, when the door is opened, the first roller can be automatically separated from the second roller by rotational force of the rotational force applying members.

The medium transport device according to a fourth aspect of the present disclosure according to the third aspect, wherein the displacement mechanism includes a slide member to which the action receiving section is attached and a first cam acting section configured to rotate the first cam and a second cam acting section configured to rotate the second cam, the first cam acting section and the second cam acting section being provided on the slide member and when the door is closed, by the acting section pushing the action receiving section, the slide member slidably moves, the first cam acting section rotates the first cam against rotational force of the first rotational force applying member, and at the same time, the second cam acting section rotates the second cam against rotational force of the second rotational force applying member so that the first roller is located at the first position.

According to this aspect, when the door is closed, the slide member slidably moves, the first cam acting section rotates the first cam against rotational force of the first rotational force applying member, and the second cam acting section rotates the second cam against rotational force of the second rotational force applying member so that the first roller is located at the first position. Accordingly, the entire the first rotation shaft can be displaced from the second position to the first position with a simple structure in which the slide member is slidably moved. That is, the first roller can be moved to a position at which the medium can be nipped between the first roller and the second roller. Further, since the slide member does not rotate, it is possible to reduce the size as compared with a structure in which the slide member rotates.

The medium transport device according to the fifth aspect of the present disclosure according to the fourth aspect, wherein the slide member has a plate shape and a plate-shaped surface of the slide member extends along a direction in which the first rotation shaft is displaced from the first position to the second position.

According to this aspect, the surface of the plate-shaped slide member is disposed along the direction in which the first rotation shaft is displaced from the first position to the second position. By this, compared to a structure in which the first rotation shaft is not disposed along the displacement direction, it is possible to achieve miniaturization in a direction, which intersects the displacement direction.

The medium transport device according to the sixth aspect of the present disclosure according to the fourth aspect or the fifth aspect, wherein the slide member slidably moves in the axial direction of the first rotation shaft.

According to this aspect, since the slide member slidably moves in the axial direction of the first rotation shaft, it is possible to achieve miniaturization while securing the movement amount of the first rotation shaft.

The medium transport device according to the seventh aspect of the present disclosure according to any one of the third aspect to the sixth aspect, wherein when the first rotation shaft is displaced from the first position to the second position, the first cam rotates in a first rotation, and the second cam rotates in a second rotation, which is in an opposite direction that is opposite to the first direction.

According to this aspect, when the first rotation shaft is displaced from the first position to the second position, the first cam rotates in the first rotation, and at the same time, the second cam rotates in the second rotation opposite direction to the first direction. That is, since one rotates clockwise and the other rotates counterclockwise to displace the first rotation shaft, the directions of rotational forces applied to the first rotation shaft are opposite to each other and offset each other, so that the first rotation shaft can be stably moved in a displacing direction.

The medium transport device according to the eighth aspect of the present disclosure according to the seventh aspect, wherein the first rotation shaft, which has the first roller, the slide member, which has the action receiving section, and the displacement mechanism, which has the first cam, the second cam, the first contact section, and the second contact section, are assembled via a frame to constitute a single unit.

According to this aspect, the first rotation shaft, the slide member, and the displacement mechanism including the first cam, the second cam, the first contact section, and the second contact section are integrally assembled into the unit. As a result, attach to the device main body is facilitated, and miniaturization is facilitated by unitization.

The medium transport device according to the ninth aspect of the present disclosure according to any one of the first aspect to eighth aspect, wherein the door is located on a side surface of the device main body, the second rotation shaft is located at a rear side of the device main body, and a front portion of the door is a free end to be opened and closed, the displacement mechanism is provided to extend in a front-rear direction along the door in the closed state, and the action receiving section is located at the rear side of the device main body.

According to this aspect, since the action receiving section is located on the rear side of the device main body, there is little possibility that the user carelessly touches the action receiving section in a state where the door is opened. Further, it is easy to reduce the size.

A recording device according to the tenth aspect of the present disclosure includes the medium transport device according to any one of the above described aspects and a recording section configured to perform recording on the medium transported by the medium transport device.

According to this aspect, effects similar to those of the above described aspects can be obtained as the recording device.

First Embodiment

Hereinafter, a medium transport device 1 according to a first embodiment of the disclosure and a recording device 100 including the medium transport device 1 will be specifically described with reference to FIGS. 1 to 8. Here, the recording device 100 will be described as an inkjet printer.

In the following description, three axes orthogonal to each other are referred to as an X-axis, a Y-axis, and a Z-axis, respectively, as shown in the drawings. The Z-axis direction corresponds to a vertical direction, that is, a direction in which gravity acts. The X-axis direction and the Y-axis direction, correspond horizontal directions. In each figure, the direction indicated by arrows of the three axes (X, Y, Z) is a +direction of each direction, and the opposite direction is a −direction. Here, the +Y direction is the front side of the recording device 100, and the −Y direction is a rear side of the recording device 100.

As shown in FIG. 1, in the present embodiment, the recording device 100 includes a line head which is a recording section 3 for performing recording by ejecting ink onto a medium S transported by a medium transport device 1. In FIG. 1, reference symbol 2 denotes a medium cassette, reference symbol 4 denotes a transport path, and reference symbol 6 denotes a discharge section.

The medium S accommodated in the medium cassette 2 is transported through the transport path 4 and passes through a recording execution area of the recording section 3 in a device main body 5. The medium S recorded by the recording section 3 is transported through the transport path 4 and is discharged to the discharge section 6. Here, the transport path 4 in the device main body 5 is not shown.

The device main body 5 is provided with a door 7. In this embodiment, the door 7 is located on a right side surface of the device main body 5, that is, a side surface in the −X direction, and has a second rotation shaft 8 (FIG. 2) serving as a rotation fulcrum on the rear side (−Y direction) of the device main body 5, and opens and closes with the front side serving as a free end 10. When the medium S is jammed in the transport path 4, the jam can be cleared by opening the door.

On the inner surface of the door 7, a path constituent member 12 constituting the transport path 4 is provided. In a state in which the door 7 is closed, the path constituent member 12 faces a path constituent member 14 on the device main body 5 side to configure the transport path 4.

Figure 2:
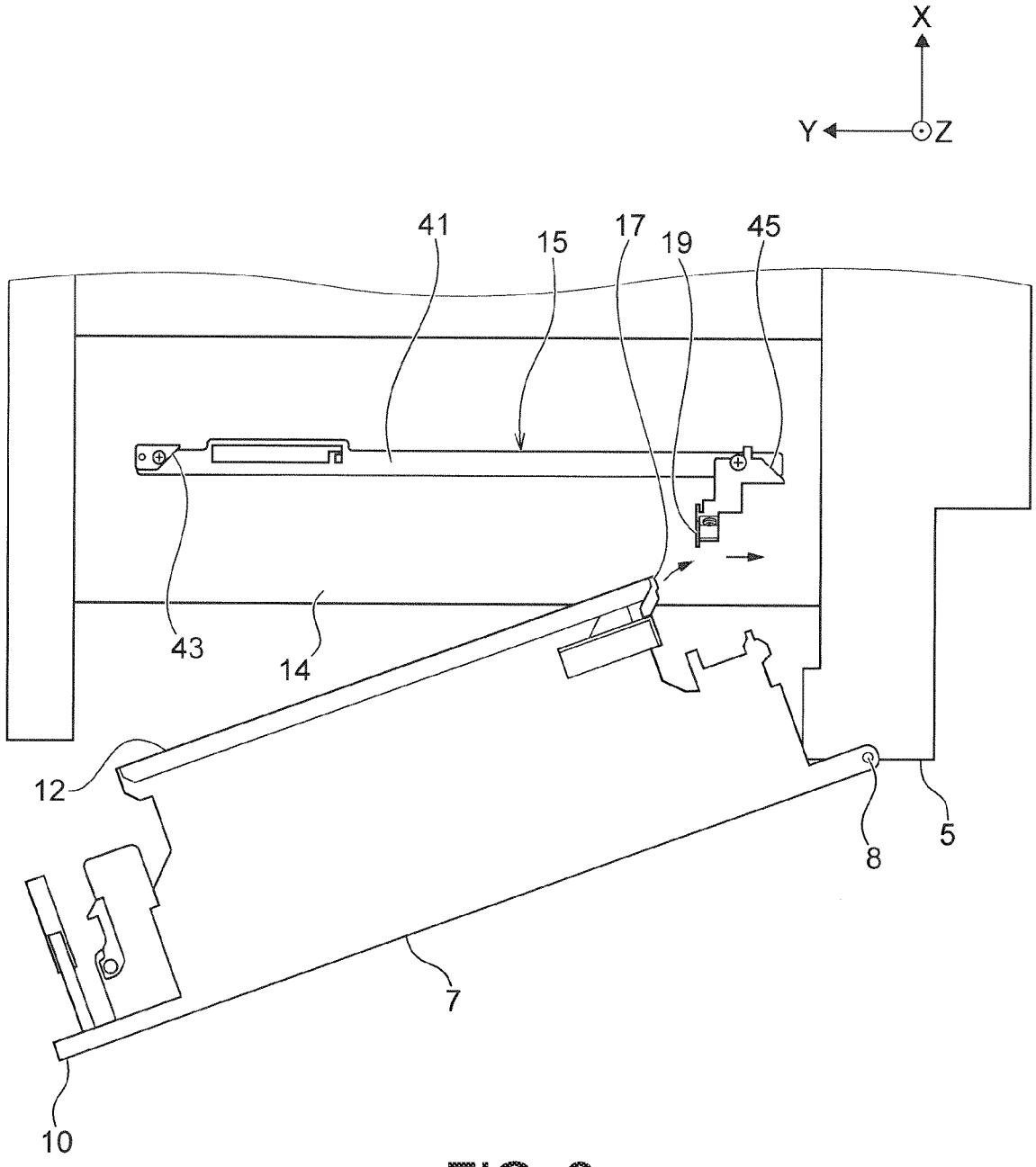
FIG. 2 is a schematic plan view of main portion of the first embodiment.
Figure 3A:
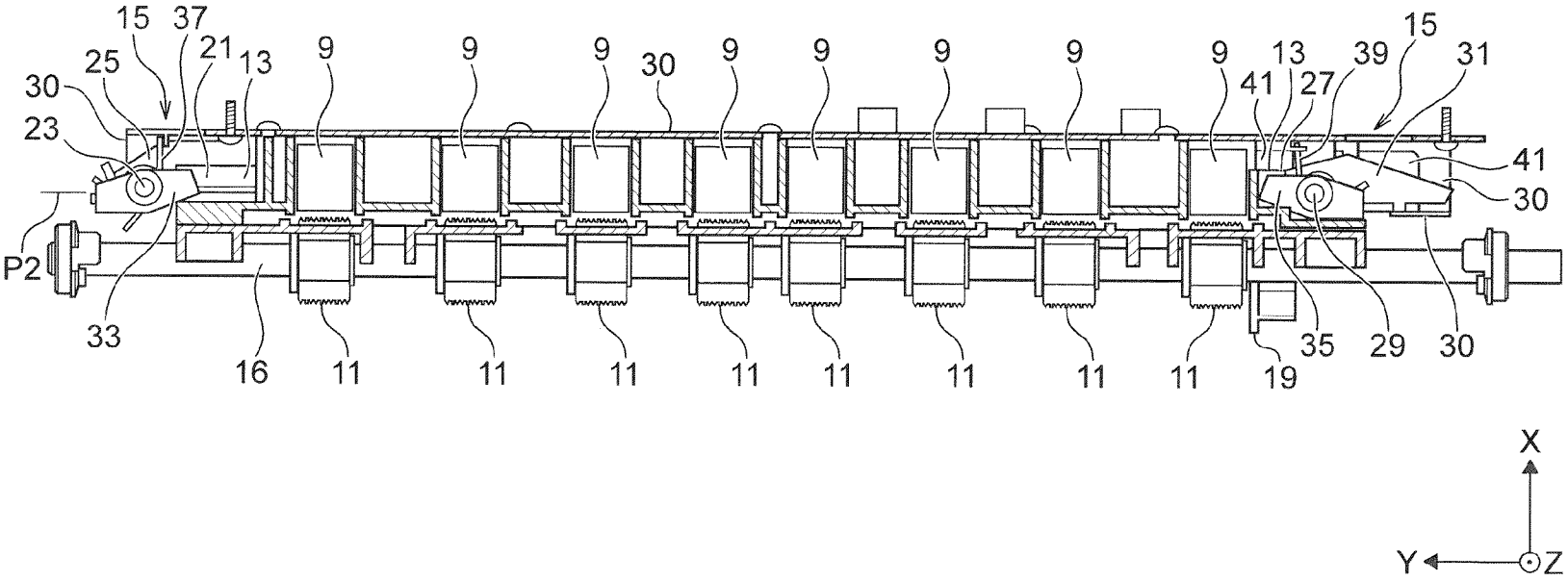
FIG. 3A is a plan view of main portions of a displacement mechanism of a medium conveying section according to the first embodiment.
Figure 3B:
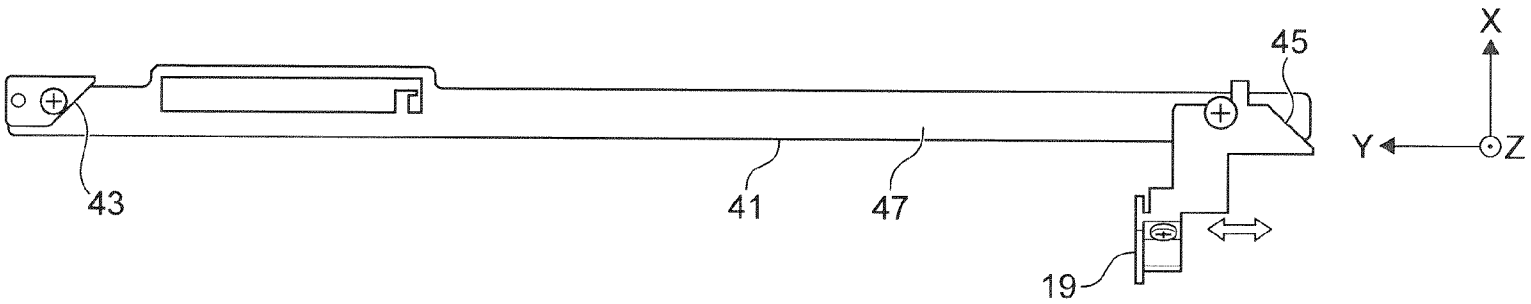
FIG. 3B is a plan view of a slide member of the displacement mechanism of the medium transport section of the first embodiment.
Figure 4:
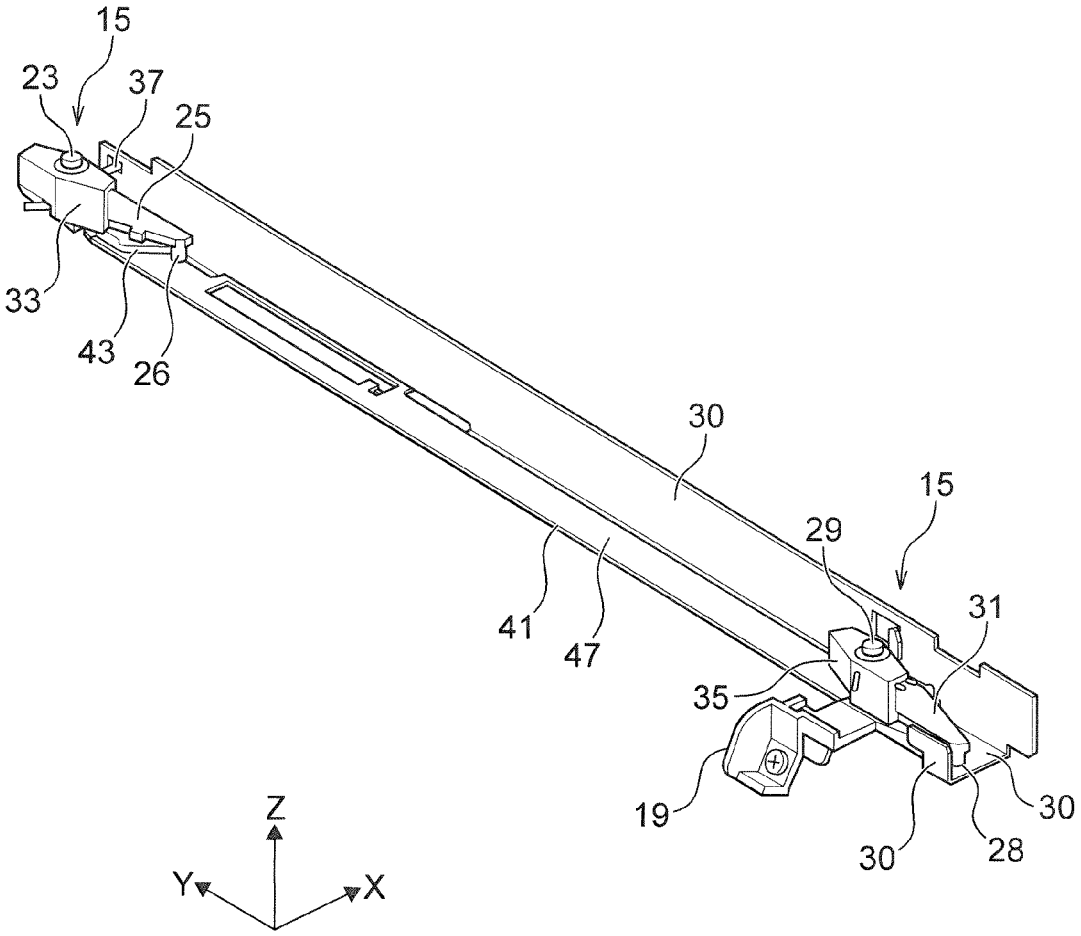
FIG. 4 is a perspective view of main portions of the displacement mechanism according to the first embodiment.

As shown in FIGS. 2 and 3A, the medium transport device 1 according to the present embodiment includes a first roller 9 that transports the medium S, a second roller 11 that nips the medium S together with the first roller 9, a first rotation shaft 13 that rotatably supports the first roller 9, a displacement mechanism 15 that displaces the first rotation shaft 13 to a first position P1 (FIGS. 7A and 7B) at which the first roller 9 and the second roller 11 can nip the medium S and a second position P2 (FIGS. 3A, 5A, and 5B) at which the first roller 9 separates from the second roller 11, and the device main body 5 that supports the displacement mechanism 15. Further, the medium transport device 1 includes the door 7. The door 7 is openable and closable around the second rotation shaft 8, which is provided as the rotation fulcrum and which extends in a direction that intersects the first rotation shaft 13, and is rotatable, with respect to the device main body 5, between an opened position at which the door 7 is opened and a closed position at which the door 7 is closed. In FIG. 2, in order to avoid complication of the drawing, a slide member 41 (to be described later) which is a component of the displacement mechanism 15 is illustrated for the displacement mechanism 15, and other components are omitted.

The door 7 has an acting section 17 (FIG. 2) at one location, and the displacement mechanism 15 has an action receiving section 19 at one location. In a state in which the door 7 is at the closed position, the acting section 17 is in contact with and presses the action receiving section 19. FIG. 2 shows a state in which the acting section 17 is not in contact with the action receiving section 19, that is, a state in which the acting section 17 does not press the action receiving section 19. In the present embodiment, the displacement mechanism 15 is provided to extend in the front-rear direction along the door 7 in the closed state, and the action receiving section 19 is located on the rear side of the device main body 5.

The displacement mechanism 15 is configured to displace the first rotation shaft 13 from the first position P1 to the second position P2 when the door 7 rotates from the closed position to the opened position and the acting section 17 no longer pushes the action receiving section 19.

Second Roller

As shown in FIG. 3A, in the present embodiment, the second roller 11 is a drive roller that rotates by drive force transmitted from a drive source (not shown). Here, the second roller 11 is formed of a toothed roller having a plurality of teeth formed on its outer peripheral surface.

The second roller 11 is supported by a shaft 16 so as to rotate integrally with the shaft 16. The shaft 16 is rotatably attached to the device main body 5.

First Roller

As shown in FIG. 3A, the first roller 9 is a driven roller that rotates with rotation of the second roller 11. The second roller 11 and the first roller 9 nip the medium S and transport the medium S through the transport path 4.

The first rotation shaft 13 of the first roller 9 is attached to the device main body 5 so as to be movable in directions approaching and separating from the second roller 11 as a whole. Here, the first rotation shaft 13 is configured to move while being guided by a guide member (not shown) and to be displaced between the first position P1 and the second position P2.

Displacement Mechanism

The structure of the displacement mechanism 15 will be described with reference to FIGS. 3A to 7B.

In the present embodiment, the displacement mechanism 15 includes a first cam 25, which is provided on the one end 21 of the first rotation shaft 13 and rotates around a first shaft 23, and a second cam 31, which is provided on the other end 27 of the first rotation shaft 13 and rotates around a second shaft 29. Further, the displacement mechanism 15 includes a first contact section 33, which rotates integrally with the first cam 25 around the first shaft 23 and which can be brought into contact with the one end 21 of the first rotation shaft 13, and a second contact section 35, which rotates integrally with the second cam 31 around the second shaft 29 and which can be brought into contact with the other end 27 of the first rotation shaft 13.

In the present embodiment, the first cam 25 and the first contact section 33, and the second cam 31 and the second contact section 35 are integrally molded from a resin material.

In the displacement mechanism 15, when the door 7 is opened and the acting section 17 no longer pushes the action receiving section 19, the first cam 25 rotates and the first contact section 33 is brought into contact with the one end 21 of the first rotation shaft 13 to move the one end 21 of the first rotation shaft 13, and at the same time, the second cam 31 rotates and the second contact section 35 is brought into contact with the other end 27 of the first rotation shaft 13 to move the other end 27 of the first rotation shaft 13.

Figure 5A:
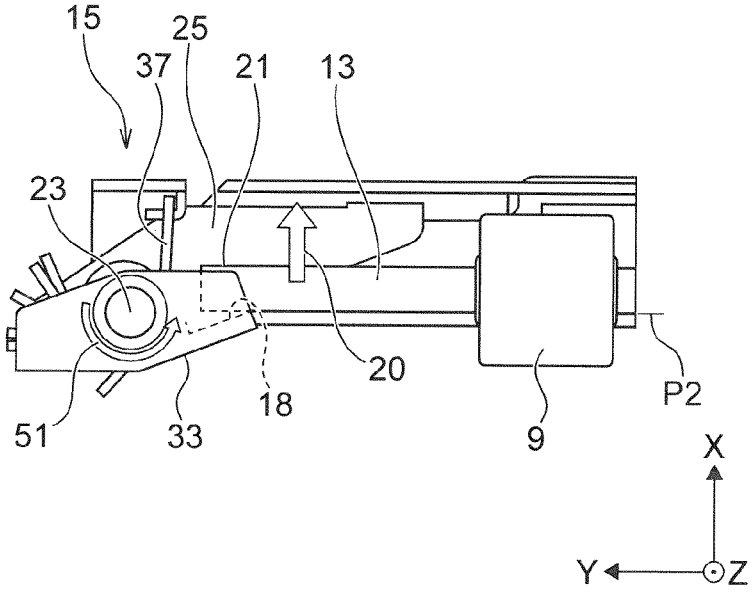
FIGS. 5A and 5B are plan views of main portions of the displacement mechanism according to the first embodiment.
Figure 5B:
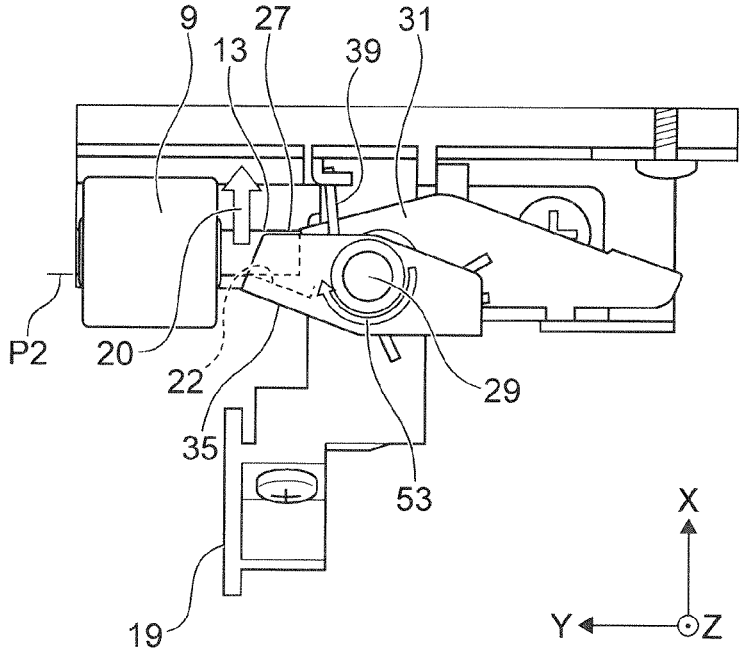
Figure 6:
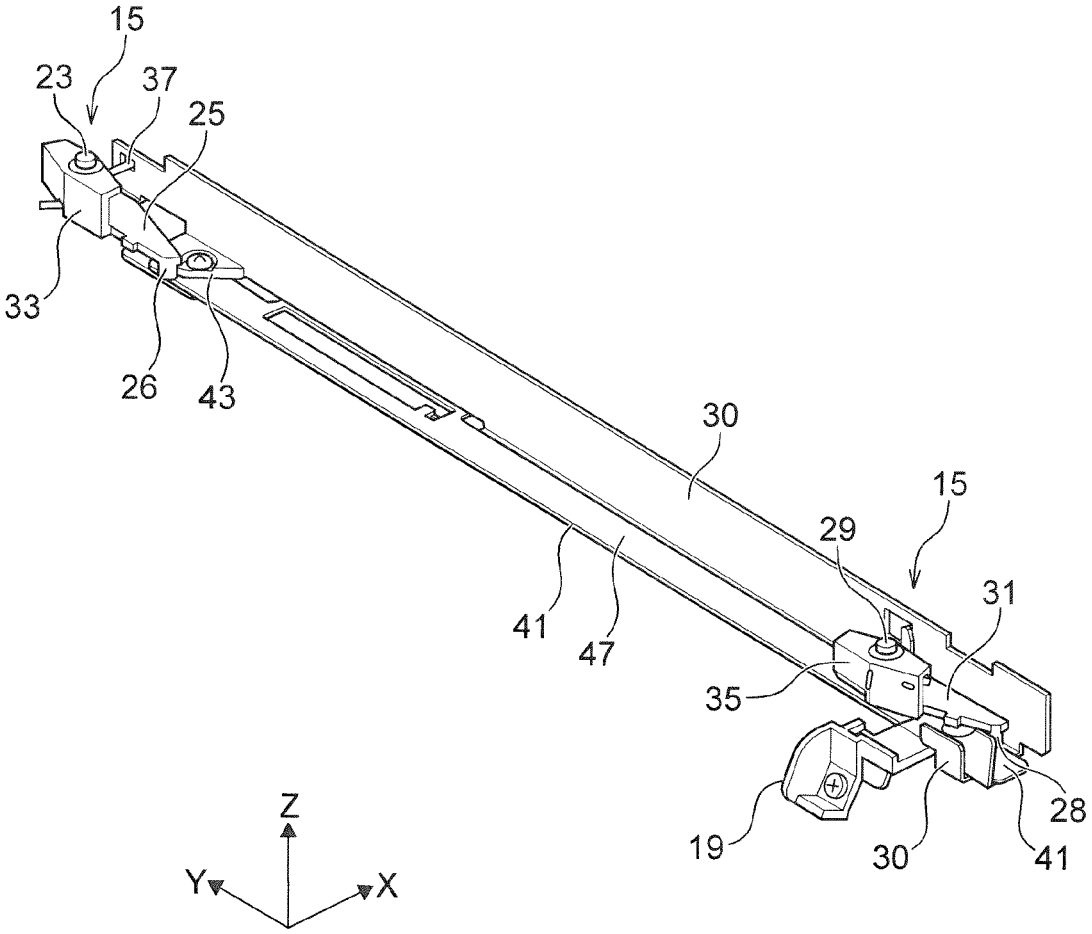
FIG. 6 is a perspective view of main portions of the displacement mechanism according to the first embodiment.

FIGS. 5A and 5B shows a state in which the first rotation shaft 13 has moved to the second position P2. In particular, FIG. 5A shows a state in which the first cam 25 is rotated so that a contact acting section 18 of the first contact section 33 is brought into contact with the one end 21 of the first rotation shaft 13 and is moved in the direction of an arrow 20 so as to be moved to the second position P2. Further, FIG. 5B shows a state in which the second cam 31 is rotated so that a contact acting section 22 of the second contact section 35 is brought into contact with the other end 27 of the first rotation shaft 13 and is moved in the direction of the arrow 20 so as to be moved to the second position P2.

Figure 7A:
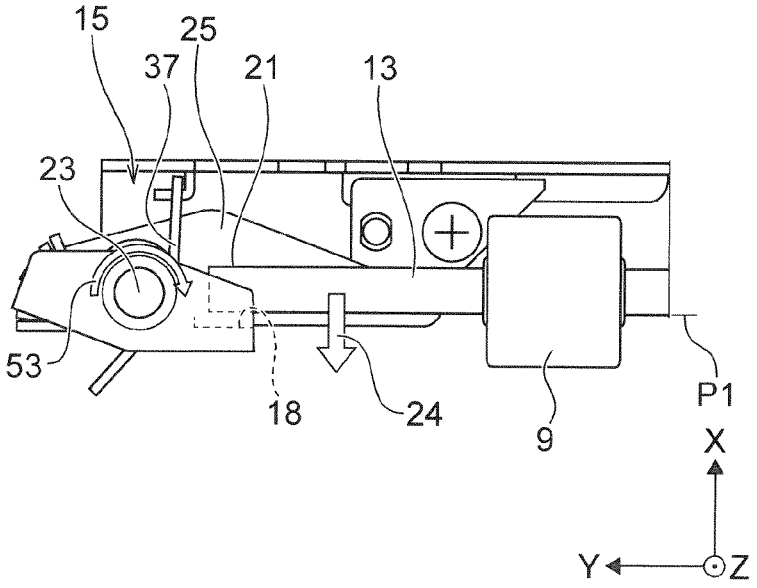
FIGS. 7A and 7B are plans view of main portions of the displacement mechanism according to the first embodiment.
Figure 7B:
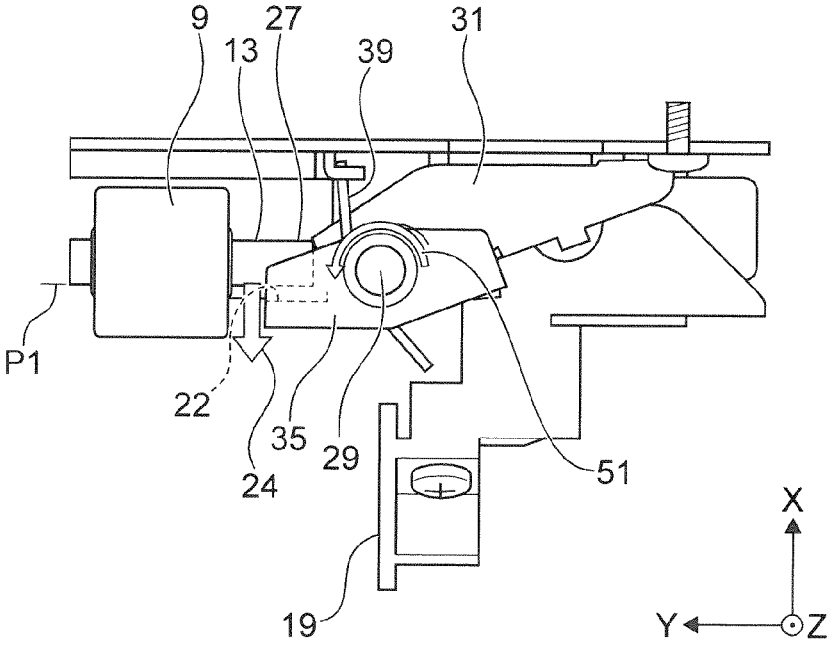

FIGS. 7A and 7B shows a state in which the first rotation shaft 13 has moved to the first position P1. In particular, FIG. 7A shows a state in which the first cam 25 rotated so that the contact acting section 18 of the first contact section 33 moves in the direction of an arrow 24, which is a direction separating from the one end 21 of the first rotation shaft 13, and moves the one end 21 of the first rotation shaft 13 to the first position P1. FIG. 7B shows a state in which the second cam 31 rotated so that the contact acting section 22 of the second contact section 35 moves in the direction of the arrow 24, which is a direction separating from the other end 27 of the first rotation shaft 13, and the other end 27 of the first rotation shaft 13 is moved to the first position P1.

By this movement, the first rotation shaft 13 is displaced from the first position P1 (FIGS. 7A and 7B) to the second position P2 (FIGS. 5A and 5B). That is, when the first rotation shaft 13 is located at the second position P2, the first roller 9 is separated from the second roller 11. In this state, it is possible to deal with a case when the medium is jammed in the transport path 4.

Further, as shown in FIGS. 3A, 3B, 5A, 5B, 7A, and 7B, in the present embodiment, the first cam 25 and the second cam 31 are applied with rotational force by a first rotational force applying member 37 and a second rotational force applying member 39, respectively. When the acting section 17 no longer pushes the action receiving section 19, the first cam 25 and the second cam 31 are rotated by the rotational force to displace the first rotation shafts 13 from the first position P1 to the second position P2. That is, the first cam 25 and the second cam 31 receive rotational force from the first rotational force applying member 37 and the second rotational force applying member 39 in such a direction as to move the first rotation shaft 13 in a direction (arrow 20) in which the first roller 9 separates from a nip position with the second roller 11.

Here, both the first rotational force applying member 37 and the second rotational force applying member 39 are torsion coil springs.

As shown in FIGS. 3A, 3B, 4, and 6, in the present embodiment, the displacement mechanism 15 includes the slide member 41 to which the action receiving section 19 is attached, a first cam acting section 43, which rotates the first cam 25, and a second cam acting section 45, which rotates the second cam 31, both the first cam 25 and the second cam 31 being provided on the slide member 41. The first cam 25 has a first sliding convex section 26 that slides in contact with the inclined side of the first cam acting section 43. The second cam 31 has a second sliding convex section 28 that slides in contact with the inclined side of the second cam acting section 45. The second sliding convex section 28 is provided by using a part of the action receiving section 19.

Here, the first rotation shaft 13 receives pressing force from a pressing spring (not shown) in a direction in which the first roller 9 moves to the nip position with the second roller 11.

When the door 7 is closed, the acting section 17 pushes the action receiving section 19, so that the slide member 41 slidably moves in the −Y direction. By this movement, the inclined side of the first cam acting section 43 rotates the first cam 25 via the first sliding convex section 26 against rotational force of the first rotational force applying member 37, and at the same time, the inclined side of the second cam acting section 45 rotates the second cam 31 via the second sliding convex section 28 against rotational force of the second rotational force applying member 39. Accordingly, the first roller 9 receives force of the pressing spring and moves to the first position P1, so that the medium S can be nipped between the first roller 9 and the second roller 11.

As shown in FIGS. 3A, 3B, 4, and 6, in the present embodiment, the slide member 41 has a plate-shape. A plate-shaped surface 47 of the slide member 41 is provided along a direction in which the first rotation shaft 13 is displaced from the first position P1 to the second position P2. In other words, the plate-shaped surface 47 is provided along the direction in which the first rotation shaft 13 is displaced. That is, it is provided along an X-Y plane direction, which intersects the Z-axis direction.

In each drawing, reference symbol 30 denotes a frame to which the first cam 25, the second cam 31, and the slide member 41 are attached.

The slide member 41 is provided on the frame 30 so as to slidably move in the axial direction (Y-axis direction) of the first rotation shaft 13.

Modification

Instead of the structure in which the slide member 41 slidably moves in the axial direction (Y-axis direction) of the first rotation shaft 13, a structure in which it slidably moves in the X-axis direction, which intersects the axial direction (Y-axis direction) of the first rotation shaft 13 may be employed. In this case, by changing the specific structure of the related members such as the first cam 25, the second cam 31, the first cam acting section 43, and the second cam acting section 45 in accordance with the movement in the X-axis direction, it is possible to exhibit the same function.

Further, as shown in FIGS. 5A and 5B, the first cam 25 and the second cam 31 in the present embodiment are configured so that, when the first rotation shaft 13 is displaced from the first position P1 to the second position P2, the first cam 25 rotates in a first rotation 51, which is counterclockwise, and at the same time, the second cam 31 rotates in a second rotation 53, which is clockwise and opposite to the first rotation 51.

As shown in FIGS. 7A and 7B, when the first rotation shaft 13 is displaced from the second position P2 to the first position P1, the first cam 25 rotates in the second rotation 53, which is clockwise, and at the same time, the second cam 31 rotates in the first rotation 51, which is counterclockwise and opposite to the second rotation 53.

Figure 8:
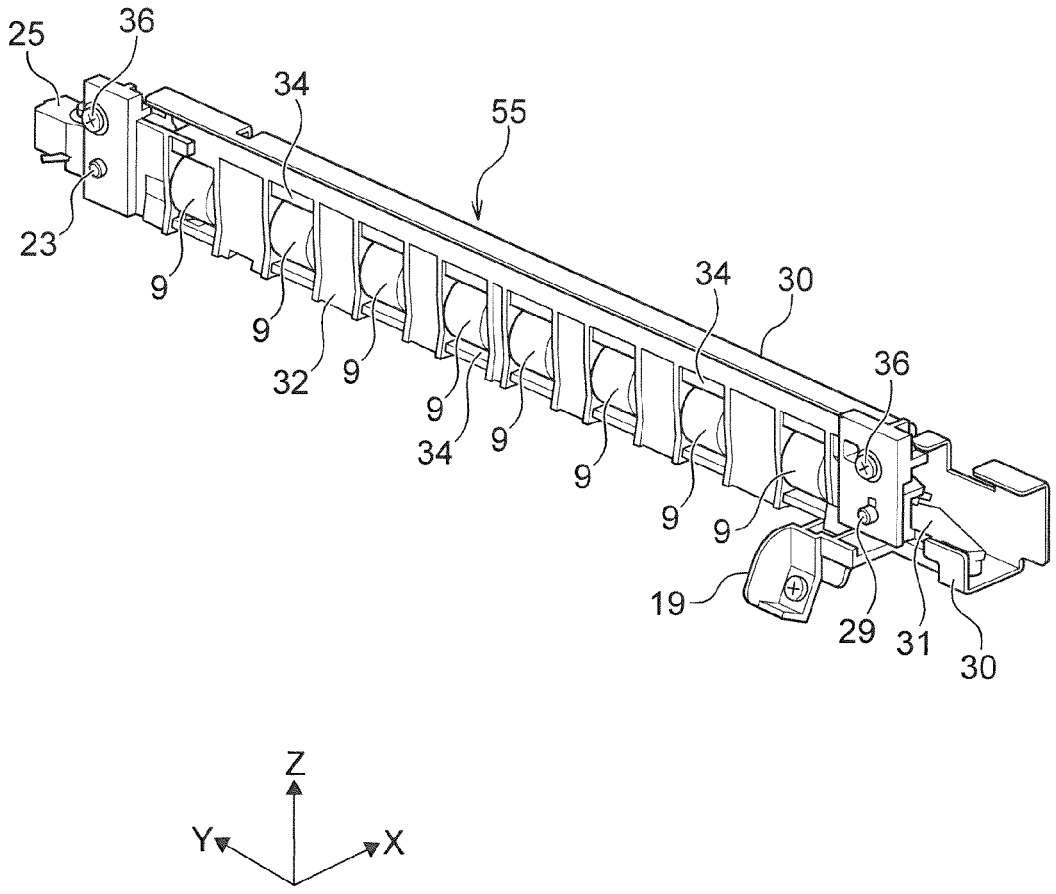
FIG. 8 is a perspective view of a unit of the displacement mechanism according to the first embodiment.

Further, as shown in FIG. 8, in the present embodiment, the first rotation shaft 13 having the first roller 9, the slide member 41 having the action receiving section 19, and the displacement mechanism 15 having the first cam 25, the second cam 31, the first contact section 33, and the second contact section 35 are assembled via the frame 30 and a window frame member 32 to constitute a single unit 55.

The window frame member 32 is fastened to the frame 30 by screws 36 in a state in which the first roller 9 is exposed from each window 34.

Description of Effects of Embodiment (1) According to the present embodiment, the door 7 including the acting section 17 and the displacement mechanism 15 including the action receiving section 19 are provided, and the acting section 17 is in contact with and presses the action receiving section 19 when the door 7 is at the closed position, and the displacement mechanism 15 is configured to displace the first rotation shaft 13 from the first position P1 to the second position P2 when the door 7 rotates from the closed position to the opened position and the acting section 17 no longer pushes the action receiving section 19. Thus, since only the acting section 17 is provided on the door 7 side, the mechanism on the door 7 side is not complicated, the weight is hardly increased, and there is little possibility that the door 7 is difficult to open and close.

(2) Further, according to the present embodiment, the structure for displacing the entire first rotation shaft 13 from the first position P1 to the second position P2 is configured by a cam structure including the first cam 25 and the first contact section 33 provided on the one end 21 side of the first rotation shaft 13 and the second cam 31 and the second contact section 35 provided on the other end 27 side of the first rotation shaft 13. Therefore, with a simple structure of a pair of the cam structures, the first roller 9 can be separated from the second roller 11 by simultaneously displacing the one end 21 and the other end 27 of the first rotation shaft 13 from the first position P1 to the second position P2.

(3) Further, according to the present embodiment, when the acting section 17 no longer pushes the action receiving section 19, the first cam 25 and the second cam 31 are rotated by rotational force to displace the first rotation shaft 13 from the first position P1 to the second position P2. Accordingly, when the door 7 is opened, the first roller 9 can be automatically separated from the second roller 11 by rotational force of the rotational force applying members 37 and 39.

(4) According to the present embodiment, when the door 7 is closed, the slide member 41 slidably moves, the first cam acting section 43 rotates the first cam 25 against rotational force of the first rotational force applying member 37, and at the same time, the second cam acting section 45 rotates the second cam 31 against rotational force of the second rotational force applying member 39, so that the first roller 9 is located at the first position P1. Accordingly, the entire the first rotation shaft 13 can be displaced from the second position P2 to the first position P1 with a simple structure in which the slide member 41 is slidably moved. In other words, the first roller 9 can be moved to a position where the medium S can be nipped between the first roller 9 and the second roller 11. Further, since the slide member 41 does not rotate, it is possible to reduce the size as compared with a rotating structure.

(5) According to the present embodiment, the surface 47 of the plate-shaped slide member 41 is disposed along a direction in which the first rotation shaft 13 is displaced from the first position P1 to the second position P2. By this, compared to a structure in which the first rotation shaft 13 is not disposed in a direction along the displacement direction, it is possible to achieve miniaturization in a direction intersecting the displacement direction.

(6) Further, according to the present embodiment, since the slide member 41 slidably moves in the axial direction of the first rotation shaft 13, it is possible to achieve miniaturization while securing the amount of movement of the first rotation shaft 13.

(7) Further, according to the present embodiment, when the first rotation shaft 13 is displaced from the first position P1 to the second position P2, the first cam 25 rotates in the first rotation 51, and at the same time, the second cam 31 rotates in the second rotation 53, which is the opposite direction to the first rotation 51. That is, since one rotates clockwise and the other rotates counterclockwise to displace the first rotation shaft 13, the directions of rotational forces applied to the first rotation shaft 13 are opposite to each other and offset each other, so that the first rotation shaft 13 can be stably moved in the displacing direction.

(8) According to the present embodiment, the first rotation shaft 13, the slide member 41, and the displacement mechanism 15 including the first cam 25, the second cam 31, the first contact section 33, and the second contact section 35 are integrally assembled into the unit 55. As a result, attachment to the device main body 5 is facilitated, and miniaturization is facilitated by unitization.

(9) Further, according to the present embodiment, since the action receiving section 19 is located on the rear side of the device main body 5, there is little possibility that the user carelessly touches the action receiving section 19 in a state where the door 7 is opened. Further, it is easy to reduce the size.

What is claimed is:

1. A medium transport device comprising:

a first roller configured to transport a medium;

a second roller configured to nip the medium together with the first roller;

a first rotation shaft configured to rotatably support the first roller;

a displacement mechanism configured to displace the first rotation shaft to a first position where the first roller and the second roller can nip the medium and a second position where the first roller is separated from the second roller;

a device main body configured to support the displacement mechanism; and a door that is configured to open and close around a second rotation shaft, which is provided as a rotation fulcrum extending in a direction intersecting the first rotation shaft, and that is configured to rotate to an opened position at which the door opens with respect to the device main body and to a closed position at which the door closes with respect to the device main body, wherein the door includes an acting section, the displacement mechanism includes an action receiving section, when the door is at the closed position, the acting section and the action receiving section are in contact with each other and the first rotation shaft is located at the first position, when the door is at the opened position, the acting section and the action receiving section are separated from each other and the first rotation shaft is positioned at the second position, the displacement mechanism includes a first cam that is provided on one end of the first rotation shaft and that is configured to rotate around a first shaft, a second cam that is provided on another end of the first rotation shaft and that is configured to rotate around a second shaft, a first contact section that is configured to rotate integrally with the first cam around the first shaft and that is configured to contact the one end of the first rotation shaft, and a second contact section that is configured to rotate integrally with the second cam around the second shaft and that is configured to contact the other end of the first rotation shaft and when the acting section no longer pushes the action receiving section, the first cam rotates and the first contact section comes into contact with the one end of the first rotation shaft to move the one end of the first rotation shaft, the second cam rotates and the second contact section comes into contact with the other end of the first rotation shaft to move the other end of the first rotation shaft, and the first rotation shaft is displaced from the first position to the second position.

2. The medium transport device according to claim 1, wherein the displacement mechanism is configured so that when the door rotates from the closed position to the opened position and the acting section no longer pushes the action receiving section, the displacement mechanism displaces the first rotation shaft from the first position to the second position.

3. The medium transport device according to claim 1, wherein the first cam and the second cam are applied with rotational force by a first rotational force applying member and a second rotational force applying member, respectively, and when the acting section no longer pushes the action receiving section, the first cam and the second cam are rotated by the rotational force to displace the first rotation shaft from the first position to the second position.

4. The medium transport device according to claim 3, wherein the displacement mechanism includes a slide member to which the action receiving section is attached and a first cam acting section configured to rotate the first cam and a second cam acting section configured to rotate the second cam, the first cam acting section and the second cam acting section being provided on the slide member and when the door is closed, the slide member slidably moves by the acting section pushing the action receiving section, the first cam acting section rotates the first cam against rotational force of the first rotational force applying member, and the second cam acting section rotates the second cam against rotational force of the second rotational force applying member so that the first roller is located at the first position.

5. The medium transport device according to claim 4, wherein the slide member has a plate shape and a plate-shaped surface of the slide member extends along a direction in which the first rotation shaft is displaced from the first position to the second position.

6. The medium transport device according to claim 4, wherein the slide member slidably moves in an axial direction of the first rotation shaft.

7. The medium transport device according to claim 3, wherein when the first rotation shaft is displaced from the first position to the second position, the first cam rotates in a first direction, and the second cam rotates in a second direction, which is in an opposite direction that is opposite to the first direction.

8. The medium transport device according to claim 7, wherein the first rotation shaft, which has the first roller, a slide member, which has the action receiving section, and the displacement mechanism, which has the first cam, the second cam, the first contact section, and the second contact section, are assembled via a frame to constitute a single unit.

9. The medium transport device according to claim 1, wherein the door is located on a side surface of the device main body and is opened and closed around the second rotation shaft, which is located at a rear side of the device main body, with a front portion of the door as a free end, the displacement mechanism is provided to extend in a front-rear direction along the door in the closed state, and the action receiving section is located at the rear side of the device main body.

10. A recording device comprising:

the medium transport device according to claim 1 and a recording section configured to perform recording on the medium transported by the medium transport device.

11. A medium transport device comprising:

a first roller configured to transport a medium;

a second roller configured to nip the medium together with the first roller;

a first rotation shaft configured to rotatably support the first roller;

a displacement mechanism configured to displace the first rotation shaft to a first position where the first roller and the second roller can nip the medium and a second position where the first roller is separated from the second roller;

a device main body configured to support the displacement mechanism; and a door that is configured to open and close around a second rotation shaft, which is provided as a rotation fulcrum extending in a direction intersecting the first rotation shaft, and that is configured to rotate to an opened position at which the door opens with respect to the device main body and to a closed position at which the door closes with respect to the device main body, wherein the door includes an acting section, the displacement mechanism includes an action receiving section, when the door is at the closed position, the acting section and the action receiving section are in contact with each other and the first rotation shaft is located at the first position, and when the door is at the opened position, the acting section and the action receiving section are separated from each other and the first rotation shaft is positioned at the second position, the displacement mechanism includes a first cam that is provided on one end of the first rotation shaft and that is configured to rotate around a first shaft, a second cam that is provided on another end of the first rotation shaft and that is configured to rotate around a second shaft, a first contact section that is configured to rotate integrally with the first cam around the first shaft and that is configured to contact the one end of the first rotation shaft, and a second contact section that is configured to rotate integrally with the second cam around the second shaft and that is configured to contact the other end of the first rotation shaft and when the door is at the opened position, the first contact section contacts the one end of the first rotation shaft, the second contact section contacts the other end of the first rotation shaft, and the first rotation shaft is located at the second position.

12. The medium transport device according to claim 11, wherein when the acting section no longer pushes the action receiving section, the first cam rotates and the first contact section comes into contact with the one end of the first rotation shaft to move the one end of the first rotation shaft, the second cam rotates and the second contact section comes into contact with the other end of the first rotation shaft to move the other end of the first rotation shaft, and the first rotation shaft is displaced from the first position to the second position.

13. A medium transport device comprising:

a first roller configured to transport a medium;

a second roller configured to nip the medium together with the first roller;

a first rotation shaft configured to rotatably support the first roller;

a displacement mechanism configured to displace the first rotation shaft to a first position where the first roller and the second roller can nip the medium and a second position where the first roller is separated from the second roller;

a device main body configured to support the displacement mechanism; and a door that is configured to open and close around a second rotation shaft, which is provided as a rotation fulcrum extending in a direction intersecting the first rotation shaft, and that is configured to rotate to an opened position at which the door opens with respect to the device main body and to a closed position at which the door closes with respect to the device main body, wherein the door includes an acting section, the displacement mechanism includes an action receiving section, when the door is at the closed position, the acting section is in contact with and presses the action receiving section, the displacement mechanism is configured so that when the door rotates from the closed position to the opened position and the acting section no longer pushes the action receiving section, the displacement mechanism displaces the first rotation shaft from the first position toward the second position, the displacement mechanism includes a first cam that is provided on one end of the first rotation shaft and that is configured to rotate around a first shaft, a second cam that is provided on another end of the first rotation shaft and that is configured to rotate around a second shaft, a first contact section that is configured to rotate integrally with the first cam around the first shaft and that is configured to contact the one end of the first rotation shaft, and a second contact section that is configured to rotate integrally with the second cam around the second shaft and that is configured to contact the other end of the first rotation shaft and when the acting section no longer pushes the action receiving section, the first cam rotates and the first contact section comes into contact with the one end of the first rotation shaft to move the one end of the first rotation shaft, the second cam rotates and the second contact section comes into contact with the other end of the first rotation shaft to move the other end of the first rotation shaft, and the first rotation shaft is displaced from the first position to the second position.

* * * * *